US010256548B2

(12) United States Patent
Stevenson et al.

(10) Patent No.: US 10,256,548 B2
(45) Date of Patent: Apr. 9, 2019

(54) RIDGED WAVEGUIDE FEED STRUCTURES FOR RECONFIGURABLE ANTENNA

(71) Applicants: Ryan A. Stevenson, Woodinville, WA (US); Jeff Dallas, Seattle, WA (US); Adam Bily, Seattle, WA (US); Mike Slota, Kirkland, WA (US); Mark LaCombe, Maple Valley, WA (US); Nathan Kundtz, Kirkland, WA (US)

(72) Inventors: Ryan A. Stevenson, Woodinville, WA (US); Jeff Dallas, Seattle, WA (US); Adam Bily, Seattle, WA (US); Mike Slota, Kirkland, WA (US); Mark LaCombe, Maple Valley, WA (US); Nathan Kundtz, Kirkland, WA (US)

(73) Assignee: KYMETA CORPORATION, Redmond, WA (US)

( * ) Notice: Subject to any disclaimer, the term of this patent is extended or adjusted under 35 U.S.C. 154(b) by 749 days.

(21) Appl. No.: 14/610,502

(22) Filed: Jan. 30, 2015

(65) Prior Publication Data

US 2015/0222021 A1 Aug. 6, 2015

Related U.S. Application Data

(60) Provisional application No. 61/934,608, filed on Jan. 31, 2014.

(51) Int. Cl.
*H01Q 13/10* (2006.01)
*H01Q 13/18* (2006.01)
(Continued)

(52) U.S. Cl.
CPC ..... *H01Q 13/103* (2013.01); *H01Q 1/3275* (2013.01); *H01Q 13/18* (2013.01);
(Continued)

(58) Field of Classification Search
CPC .. H01Q 15/0086; H01Q 1/3275; H01Q 13/18; H01Q 13/103; H01Q 21/0043
(Continued)

(56) References Cited

U.S. PATENT DOCUMENTS 3,590,460 A * 7/1971 Highducheck ..... B21D 39/04 29/421.1
3,987,454 A * 10/1976 Epis ..... H01Q 21/0043 333/248
(Continued)

FOREIGN PATENT DOCUMENTS

WO 2004005993 1/2004
WO 2014025425 2/2014

OTHER PUBLICATIONS

Mikala C. Johnson, et al. "Side lobe cancelling for Reconfigurable Holographic Metamaterial Antenna", IEEE, 2015, vol. 63, Issue 4, pp. 1881-1886.
(Continued)

*Primary Examiner* — Dameon E Levi
*Assistant Examiner* — Ab Salam Alkassim, Jr.
(74) *Attorney, Agent, or Firm* — Womble Bond Dickinson (US) LLP

(57) ABSTRACT

A reconfigurable holographic antenna includes a metamaterial layer and a waveguide with at least one ridge. The metamaterial layer includes an array of tunable slots configurable to form holographic diffraction patterns. A reactance of each tunable slot in the array of tunable slots is individually tunable. The at least one ridge influences coupling between tunable slots in the array of tunable slots. The holographic diffraction patterns formed by the array of tunable slots generate a desired antenna wave in response to a received feed wave.

21 Claims, 13 Drawing Sheets

(51) Int. Cl.
*H01Q 21/00* (2006.01)
*H01Q 1/32* (2006.01)
*H01Q 15/00* (2006.01)

(52) U.S. Cl.
CPC ..... *H01Q 15/0086* (2013.01); *H01Q 21/005* (2013.01); *H01Q 21/0043* (2013.01)

(58) Field of Classification Search
USPC ..... 343/702, 771; 342/368
See application file for complete search history.

(56) References Cited

U.S. PATENT DOCUMENTS 4,716,417 A 12/1987 Grumet
4,862,186 A 8/1989 Strider
4,924,235 A 5/1990 Fujisaka et al.
4,978,934 A 12/1990 Saad
5,165,104 A 11/1992 Weverka
5,194,972 A 3/1993 Lim et al.
5,638,079 A * 6/1997 Kastner ..... H01Q 13/22 343/768
5,661,493 A 8/1997 Uher et al.
5,757,329 A * 5/1998 Hoover ..... H01Q 13/18 29/600
6,028,562 A 2/2000 Guler et al.
6,232,931 B1 * 5/2001 Hart ..... H01Q 15/002 343/776
6,388,631 B1 5/2002 Livingston et al.
6,459,414 B1 10/2002 Levis et al.
6,489,931 B2 * 12/2002 Liu ..... H01Q 3/0275 343/703
7,068,234 B2 * 6/2006 Sievenpiper ..... H01Q 3/26 343/745
7,071,888 B2 * 7/2006 Sievenpiper ..... H01Q 13/20 343/745
7,307,596 B1 * 12/2007 West ..... H01Q 3/2658 343/778
7,463,154 B2 12/2008 Cortina et al.
7,609,223 B2 * 10/2009 Manasson ..... H01Q 3/24 343/700 MS
7,613,468 B2 11/2009 Hamilton et al.
7,667,660 B2 * 2/2010 Manasson ..... H01Q 13/02 343/781 P
7,830,310 B1 * 11/2010 Sievenpiper ..... H01Q 1/38 343/700 MS
8,044,866 B2 10/2011 Weaver
8,059,051 B2 * 11/2011 Manasson ..... H01Q 13/28 343/700 MS
8,803,735 B2 8/2014 McClure
8,811,914 B2 8/2014 Britz et al.
8,908,251 B2 12/2014 Sayyah et al.
8,994,609 B2 * 3/2015 Gregoire ..... H01Q 13/26 343/700 MS
9,190,737 B2 11/2015 Sano et al.
9,379,446 B1 * 6/2016 Schuss ..... H01Q 13/18
9,385,435 B2 * 7/2016 Bily ..... H01Q 13/22
9,411,042 B2 8/2016 Brady et al.
9,455,495 B2 9/2016 Gregoire
9,488,729 B2 11/2016 Averin et al.
9,520,653 B2 12/2016 Sano et al.
2002/0039083 A1 4/2002 Taylor et al.
2002/0167456 A1 * 11/2002 McKinzie, III ..... H01Q 3/46 343/909
2004/0046963 A1 * 3/2004 Lackritz ..... G01N 21/253 356/445
2004/0263408 A1 * 12/2004 Sievenpiper ..... H01Q 3/46 343/757
2005/0146476 A1 * 7/2005 Wang ..... G01S 3/14 343/771
2005/0146477 A1 * 7/2005 Kelly ..... H01Q 1/3275 343/771
2005/0146478 A1 * 7/2005 Wang ..... H01Q 1/288 343/771
2006/0097942 A1 * 5/2006 Tanaka ..... H01Q 15/0006 343/770
2006/0114170 A1 * 6/2006 Sievenpiper ..... H01Q 15/24 343/909
2006/0132372 A1 * 6/2006 Jung ..... H01Q 1/3275 343/766
2006/0132374 A1 * 6/2006 Wang ..... H01Q 1/3275 343/770
2007/0103381 A1 5/2007 Upton
2007/0159395 A1 * 7/2007 Sievenpiper ..... H01Q 9/30 343/700 MS
2007/0159396 A1 * 7/2007 Sievenpiper ..... H01Q 9/30 343/700 MS
2007/0176846 A1 * 8/2007 Vazquez ..... H01Q 1/425 343/909
2007/0182639 A1 * 8/2007 Sievenpiper ..... H01Q 15/008 343/700 MS
2007/0200764 A1 * 8/2007 Cho ..... H01Q 21/0087 343/700 MS
2008/0007472 A1 1/2008 Welch et al.
2008/0013878 A1 * 1/2008 Fujiwara ..... B82Y 20/00 385/12
2008/0165079 A1 * 7/2008 Smith ..... B82Y 20/00 343/911 R
2009/0066597 A1 * 3/2009 Yang ..... H01P 3/121 343/771
2009/0085133 A1 4/2009 Doan
2009/0135076 A1 * 5/2009 Foo ..... H01Q 1/246 343/836
2009/0289863 A1 * 11/2009 Lier ..... H01Q 1/288 343/753
2010/0066629 A1 * 3/2010 Sievenpiper ..... H01Q 1/288 343/834
2010/0156573 A1 * 6/2010 Smith ..... H01P 3/081 333/239
2010/0207803 A1 8/2010 McMakin et al.
2010/0277374 A1 * 11/2010 Ju ..... H01Q 21/065 343/700 MS
2011/0070893 A1 3/2011 Hamilton et al.
2012/0194399 A1 * 8/2012 Bily ..... H01Q 13/28 343/772
2013/0050039 A1 * 2/2013 Chen ..... H01Q 13/22 343/771
2013/0214972 A1 * 8/2013 Woodell ..... H01Q 1/281 342/372
2014/0085139 A1 3/2014 Leandro et al.
2014/0159949 A1 * 6/2014 Mialhe ..... H01Q 1/281 342/26 B
2014/0211298 A1 * 7/2014 Sayyah ..... H01P 7/082 359/298
2014/0255040 A1 * 9/2014 Fujita ..... G02B 6/1225 398/130
2014/0266946 A1 * 9/2014 Bily ..... H01Q 13/22 343/771
2015/0030256 A1 1/2015 Brady et al.
2015/0109178 A1 * 4/2015 Hyde ..... H01Q 3/44 343/772
2015/0109181 A1 * 4/2015 Hyde ..... H01Q 15/0053 343/833
2015/0219497 A1 * 8/2015 Johs ..... G01J 4/02 356/367
2015/0222022 A1 * 8/2015 Kundtz ..... H01Q 21/24 343/771
2015/0236415 A1 * 8/2015 Bily ..... H01Q 3/34 342/372
2015/0288063 A1 * 10/2015 Johnson ..... H01Q 15/0086 342/352
2015/0318621 A1 * 11/2015 Apostolos ..... H01Q 3/34 343/776
2016/0056539 A1 * 2/2016 Fujita ..... H01Q 15/18 343/834
2016/0141754 A1 * 5/2016 Leyh ..... H01Q 3/247 342/372
2016/0261043 A1 * 9/2016 Sazegar ..... H01Q 3/34
2016/0329639 A1 * 11/2016 Kasahara ..... H01Q 13/22
2017/0170557 A1 * 6/2017 Shipton ..... C09K 19/3003

(56) References Cited

U.S. PATENT DOCUMENTS

| | | | | |
|---|---|---|---|---|
| 2017/0302004 | A1* | 10/2017 | Stevenson | H01Q 3/2676 |
| 2017/0331186 | A1* | 11/2017 | Linn | H01Q 3/242 |
| 2018/0115068 | A1* | 4/2018 | Sazegar | H01Q 21/0031 |
| 2018/0323490 | A1* | 11/2018 | Harp | H01Q 1/1207 |

OTHER PUBLICATIONS

Jonathan Yun Lau, "A Planar Reconfigurable Aperture with Lens and Reflect array Modes of Operation", IEEE, 2010, vol. 58, Issue 12, pp. 3547-3555.

Timothy Sleasman, et al., "Waveguide-Fed Tunable Metamaterial Element for Dynamic Apertures", IEEE, 2016, vol. 15, pp. 606-609.

* cited by examiner

RIDGED WAVEGUIDE WITH PITCHED RESONATOR LAYER

RIDGED WAVEGUIDE WITH INVERTED RESONATOR LAYER

RIDGED WAVEGUIDE FEED STRUCTURES FOR RECONFIGURABLE ANTENNA

RELATED APPLICATIONS

This application is a non-provisional application that claims priority to U.S. Provisional Application No. 61/934,608 entitled "Waveguide Feed Structures for Reconfigurable Holographic Metamaterial Surface Antenna," filed Jan. 31, 2014. Provisional Application No. 61/934,608 is hereby incorporated by reference.

This application is related to a non-provisional application entitled, "Waveguide Feed Structures for Reconfigurable Antenna," filed on the same day.

TECHNICAL FIELD

This disclosure relates generally to antennas, and in particular to reconfigurable antennas.

BACKGROUND INFORMATION

Consumer and commercial demand for connectivity to data and media is increasing. Improving connectivity can be accomplished by decreasing form factor, increasing performance, and/or expanding the use cases of communication platforms. Transmitters and receivers of wireless data platforms present increased challenges when the transmitter and/or the receiver are moving.

Satellite communication is one context where at least one of the transmitter and receiver may be moving. For example, satellite communication delivery to a residential environment may include a fixed satellite dish and a moving satellite. In an example where satellite communication is delivered to a mobile platform (e.g. automobile, aircraft, watercraft) both the satellite and the mobile platform may be moving. Conventional approaches to address these movements include satellite dishes that may be coupled to mechanically steerable gimbals to point the satellite dish in the correct direction to send/receive the satellite data. However, the form factor of satellite dishes and mechanically moving parts limits the use contexts for these prior solutions, among other disadvantages. Other approaches have been attempted to decrease the form factor of antennas in wireless communication systems, but these approaches provide limited performance.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Embodiments of a reconfigurable holographic antenna, a communication system that includes a reconfigurable holographic antenna, and a method of operating a reconfigurable holographic antenna are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
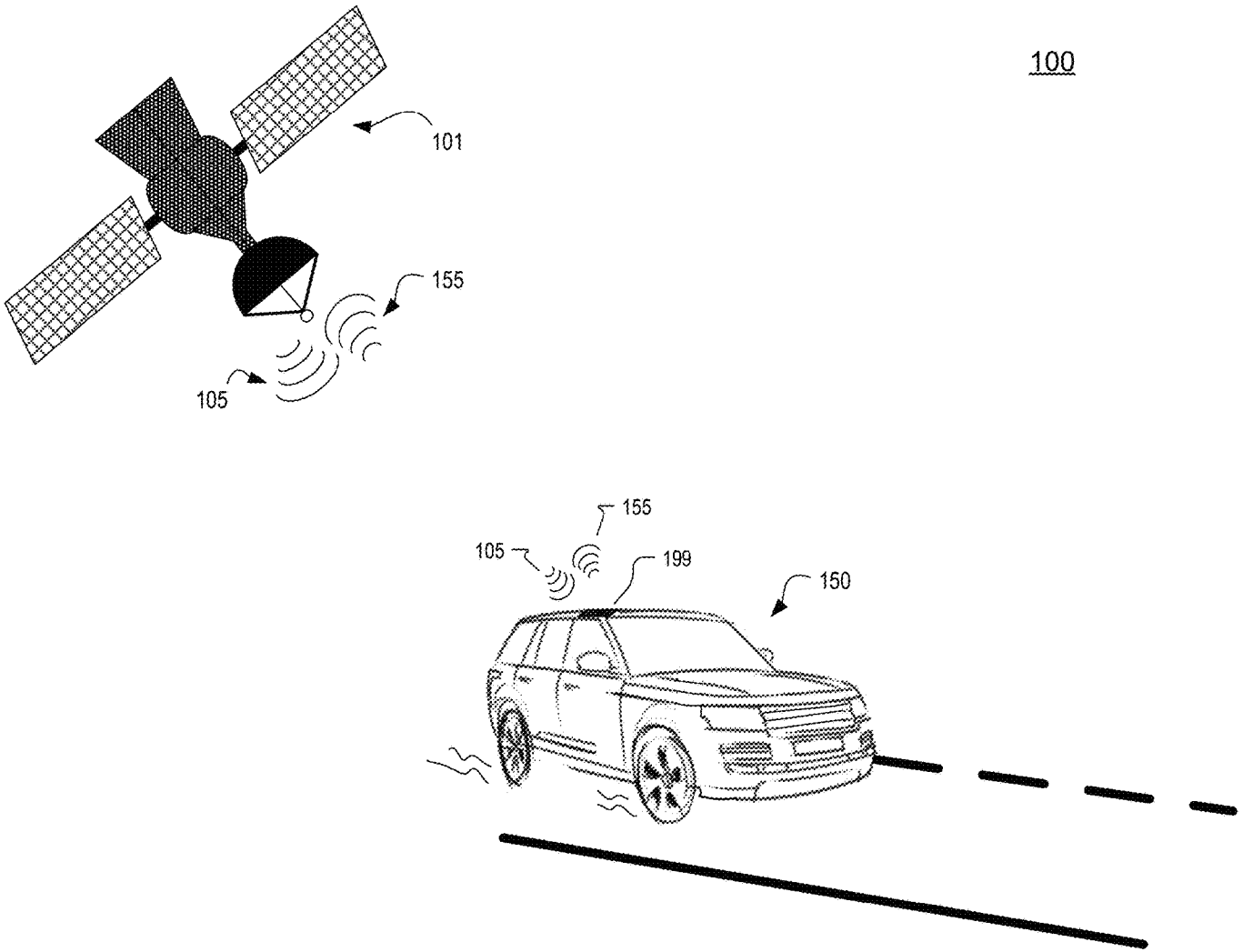
FIG. 1 illustrates a satellite communication system that includes a satellite and a mobile platform that includes a reconfigurable holographic antenna, in accordance with an embodiment of the disclosure.

FIG. 1 illustrates a satellite communication system 100 that includes a satellite 101 and a mobile platform 150 that includes a reconfigurable holographic antenna 199, in accordance with an embodiment of the disclosure. A mobile platform may be an automobile, aircraft, watercraft, or otherwise. Reconfigurable holographic antenna 199 may also be used in a fixed context (e.g. residential satellite television/internet). Satellite 101 includes a satellite antenna that radiates a downlink signal 105 and can receive an uplink signal 155. Mobile platform 150 includes reconfigurable holographic antenna 199 which receives downlink signal 105. Reconfigurable holographic antenna 199 may also transmit an uplink signal 155. Downlink signal 105 and uplink signal 155 may be in the Ka-band frequencies and/or Ku-band frequencies for civil commercial satellite communications, for example.

Reconfigurable holographic antenna 199 uses meta-material technology to form transmit beams (e.g. signal 155) that are directed toward satellite 101 and to steer received beams (e.g. signal 105) to receivers for decoding. In one embodiment, the antenna systems are analog systems, in contrast to antenna systems that employ digital signal processing to electrically form and steer beams (such as phased array antennas). Reconfigurable holographic antenna 199 may be considered a "surface" antenna that is planar and relatively low profile, especially when compared to conventional satellite dish receivers.

Figure 2A:
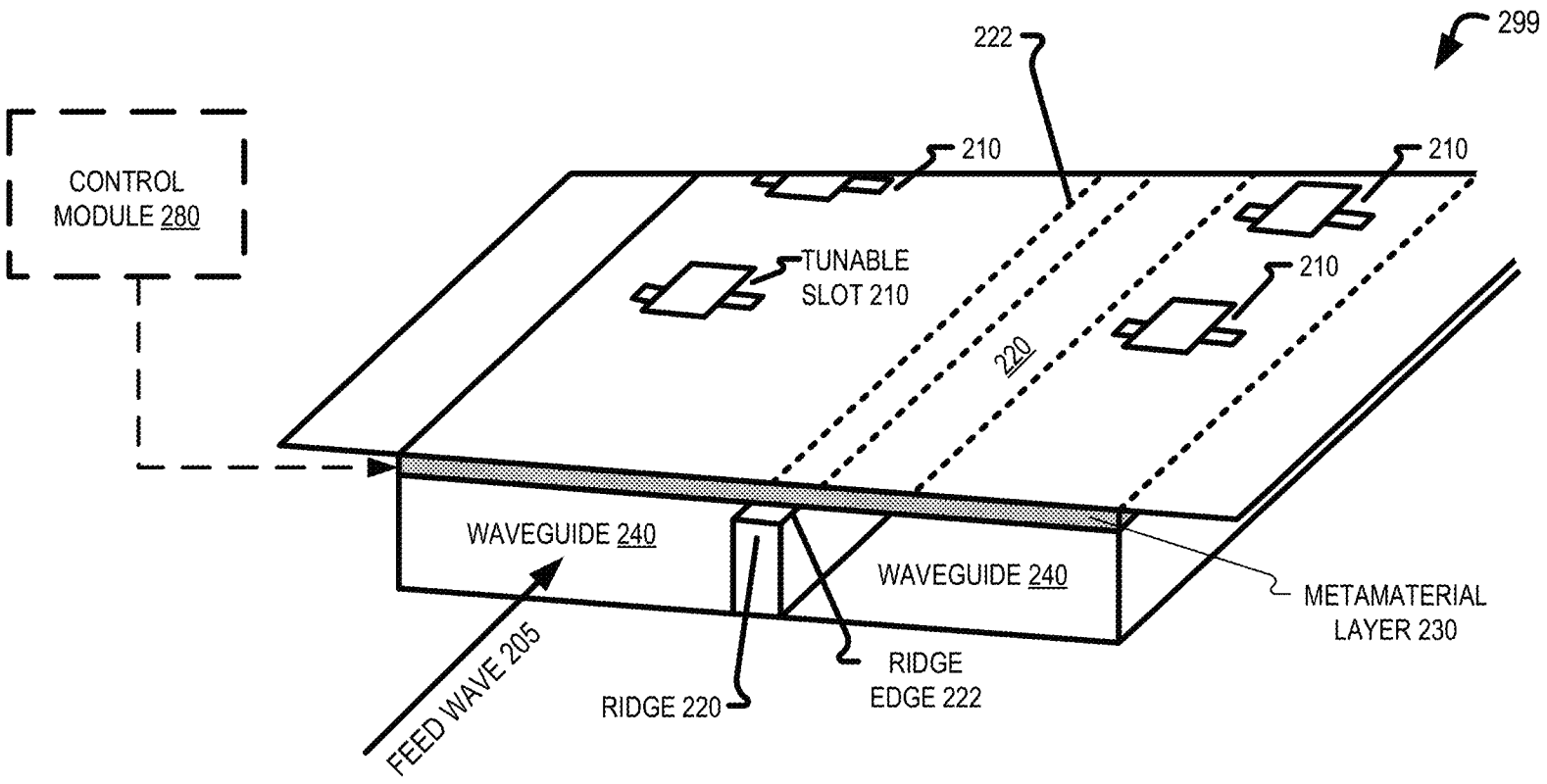
FIG. 2A illustrates a perspective view of a reconfigurable holographic antenna that includes a ridge, in accordance with an embodiment of the disclosure.

FIG. 2A illustrates a perspective view of a reconfigurable holographic antenna 299 that includes a ridged waveguide 240 and a metamaterial layer 230. It is appreciated that reconfigurable holographic antenna 299 may include a plurality of the waveguide structures illustrated in FIGS. 2A-2D. Metamaterial layer 230 includes an array of tunable slots 210. The array of tunable slots 210 can be configured to form holographic diffraction patterns that "steer" a feed wave 205 in a desired direction. To effect the holographic diffraction patterns, a reactance of each of the tunable slots can be tuned/adjusted by tuning a tunable dielectric within the tunable slot. In one embodiment, metamaterial layer 230 includes liquid crystal as the tunable dielectric and tuning the reactance of each of the tunable slots 210 includes varying a voltage across the liquid crystal. The elemental design and spacing of tunable slots 210 makes layer 230 a "metamaterial" layer because the layer as a whole provides an "effective medium" that feed wave 205 sees as a continuous refractive index without causing perturbations to the phase of feed wave 205. Consequently, metamaterial layer 230 and waveguide 240 are dimensioned to be many wavelengths (of feed wave 205) in length in FIG. 2A.

Control module 280 is coupled to metamaterial layer 230 to modulate the array of tunable slots 210 by varying the voltage across the liquid crystal in FIG. 2A. Control module 280 may include a Field Programmable Gate Array ("FPGA"), a microprocessor, or other processing logic. Control module 280 may include logic circuitry (e.g. multiplexor) to drive the array of tunable slots 210. Control module 280 may be embedded within metamaterial layer 230. Control module 280 may receive data that includes specifications for the holographic diffraction pattern to be driven onto the array of tunable slots 210. The holographic diffraction patterns may be generated in response to a spatial relationship between the reconfigurable holographic antenna and a satellite so that the holographic diffraction pattern steers downlink beam 105 and uplink beam 155 in the appropriate direction for communication. Although not drawn in each Figure, a control module similar to control module 280 may drive each array of tunable slots described in the Figures of the disclosure.

Optical holograms generate an "object beam" (often times an image of an object) when they are illuminated with the original "reference beam." Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 205 (approximately 20 GHz. in some embodiments). To "steer" a feed wave (either for transmitting or receiving purposes), an interference pattern is calculated between the desired RF beam (the object beam) and the feed wave (the reference beam). The interference pattern is driven onto the array of tunable slots 210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system.

The holographic diffraction pattern may be recalculated dynamically (i.e. more than once per second) and driven onto the array of tunable slots as the mobile platform and/or the satellites move to keep up with the changing spatial relationship between the satellite(s) and the reconfigurable holographic antenna. Control module 280 may constantly receive location inputs from sensors (e.g. global positioning satellite ("GPS") units) and/or networks (wired or wireless) so that it can properly calculate the interference pattern based on a spatial relationship between the reconfigurable holographic antenna and the satellite. When a reconfigurable holographic antenna is deployed in a fixed location (e.g. residential context) the holographic diffraction pattern may be calculated less often.

Figure 2B:
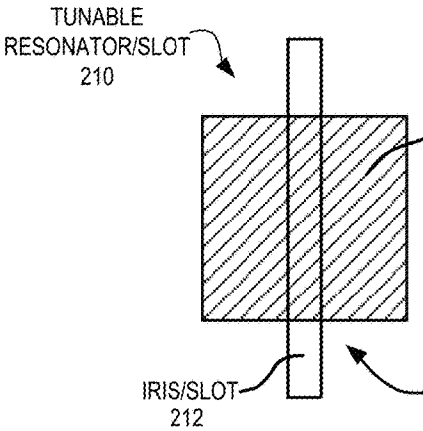
FIG. 2B illustrates a tunable resonator for use in a reconfigurable holographic antenna, in accordance with an embodiment of the disclosure.

FIG. 2B illustrates a tunable resonator/slot 210, in accordance with an embodiment of the disclosure. Tunable slot 210 includes an iris/slot 212, a radiating patch 211, and liquid crystal 213 disposed between iris 212 and patch 211. Radiating patch 211 is co-located with iris 212.

Figure 2C:
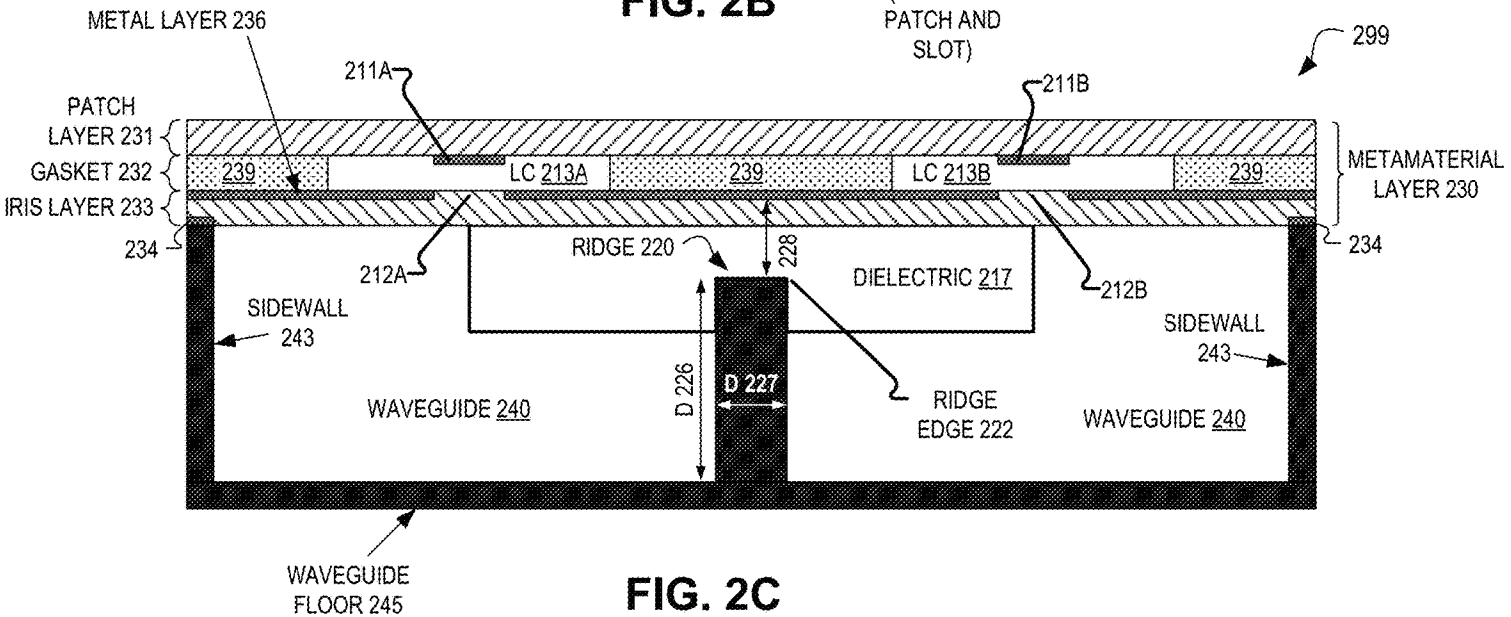
FIGS. 2C-2D illustrate different views of a reconfigurable holographic antenna that includes a ridge, in accordance with an embodiment of the disclosure.

FIG. 2C illustrates a cross section view of reconfigurable holographic antenna 299, in accordance with an embodiment of the disclosure. Waveguide 240 is bound by waveguide sidewalls 243, waveguide floor 245, ridge 220, and a metal layer 236 within iris layer 233, which is included in metamaterial layer 230. Iris/slot 212 is defined by openings in metal layer 236. Feed wave 205 may have a microwave frequency compatible with satellite communication channels. Waveguide 240 is dimensioned to efficiently guide feed wave 205.

Metamaterial layer 230 also includes gasket layer 232 and patch layer 231. Gasket layer 232 is disposed between patch layer 231 and iris layer 233. Iris layer 233 may be a printed circuit board ("PCB") that includes a copper layer as metal layer 236. Openings may be etched in the copper layer to form slots 212. Iris layer 233 is conductively coupled to waveguide 240 by conductive bonding layer 234, in FIG. 2C. Conductive bonding layer 234 may be conductively coupled to metal layer 236 by way of a plurality of vias and/or metal layers that function to continue the sidewalls 253 up to metal layer 236. Other conductive bonding layers within the disclosure may be similarly coupled to their respective metal layers. Patch layer 231 may also be a PCB that includes metal as radiating patches 211. Gasket layer 232 includes spacers 239 that provide a mechanical standoff to define the dimension between metal layer 236 and patch 211. Spacers 239 are 125 microns tall in one embodiment although spacers 239 may be shorter in other embodiments. Tunable resonator/slot 210A includes patch 211A, liquid crystal 213A, and iris 212A. Tunable resonator/slot 210B includes patch 211B, liquid crystal 213B and iris 212B. The chamber for liquid crystal 213 is defined by spacers 239, iris layer 233 and metal layer 236. When the chamber is filled with liquid crystal, patch layer 231 can be laminated onto spacers 239 to seal liquid crystal within metamaterial layer 230.

A voltage between patch layer 231 and iris layer 233 can be modulated to tune the liquid crystal within the slots 210. Adjusting the voltage across liquid crystal 213 changes the orientation of liquid crystal 213 within the chamber, which in turn varies the capacitance of slot 210. Accordingly, the reactance of slot 210 can be varied by changing the capacitance. Resonant frequency of slot 210 also changes according to the equation $$\omega = \frac{1}{\sqrt{LC}}$$

where ω is the resonant frequency of slot 210 and L and C are the inductance and capacitance of slot 210, respectively. The resonant frequency of slot 210 affects the energy radiated from feed wave 205 propagating through the waveguide. As an example, if feed wave 205 is 20 GHz., the resonant frequency of a slot 210 may be adjusted (by varying the capacitance) to 17 GHz. so that the slot 210 couples substantially no energy from feed wave 205. Or, the resonant frequency of a slot 210 may be adjusted to 20 GHz. so that the slot 210 couples energy from feed wave 205 and radiates that energy into free space. Although the examples given are digital (fully radiating or not radiating at all), full grey scale control of the reactance, and therefore the resonant frequency of slot 210 is possible with voltage variance over an analog range. Hence, the energy radiated from each slot 210 can be finely controlled so that detailed holographic diffraction patterns can be formed by the array of tunable slots.

FIG. 2C shows that ridge 220 rises from waveguide floor 245. In one embodiment, ridge 220 is 0.040 inches tall (dimension 226) and 0.025 inches wide (dimension 227). A gap 228 between ridge 220 and metal layer 236 is 0.008 inches and the width (sidewall to sidewall) is 0.34 inches, in one embodiment. A dielectric 217 (e.g. polytetrafluoroethylene or Rexolite) is disposed between the top of ridge 220 and metamaterial layer 230, in FIG. 2C. Dielectric 217 may serve as a mechanical stabilizer as well as provide a preferred index of refraction to "slow" the propagation of feed wave 205 down waveguide 240.

Sidewalls 243, waveguide floor 245, and ridge 220 may be a contiguous structure. In one embodiment, an extruded metal (e.g. extruded aluminum) forms the contiguous structure. Alternatively, the contiguous structure may be milled/machined from solid metal stock. Other techniques and materials may be utilized to form the contiguous waveguide structure.

Figure 2D:
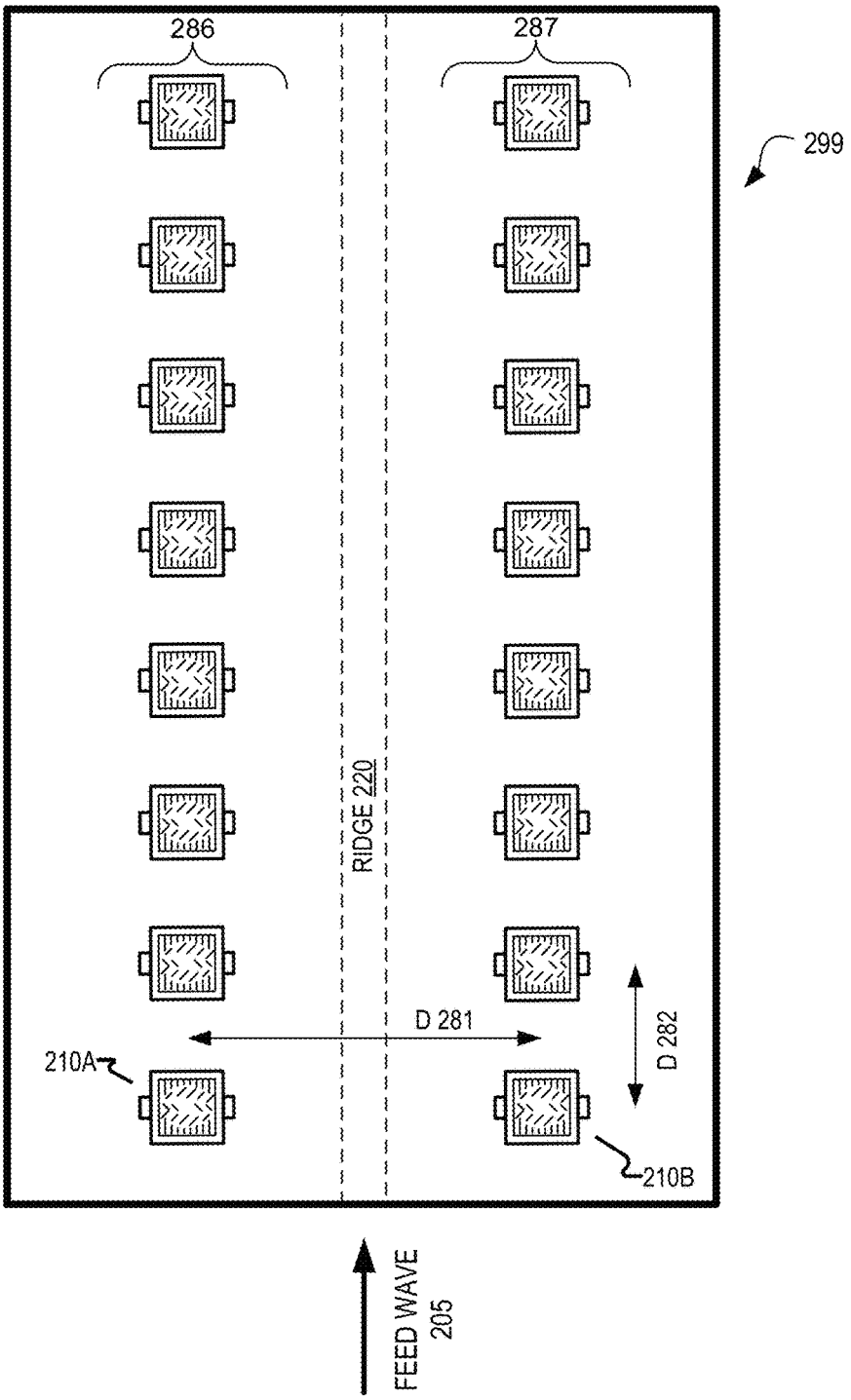

FIG. 2D illustrates a plan view of reconfigurable holographic antenna 299, in accordance with an embodiment of the disclosure. In FIG. 2D, a 2×8 array of tunable slots 210 is shown for illustration purposes, although much larger arrays may be utilized. FIG. 2D shows that ridge 220 runs lengthwise down waveguide 240. In some embodiments, ridge 220 is positioned between a first half 286 and a second half 287 of the array of tunable slots 210. The first half 286 of the array of tunable slots may be spaced from the second half 287 of the array of tunable slots by λ/2, represented by dimension 286, where λ is a wavelength of feed wave 205. Each tunable slot 210 in the first half 286 is spaced from other tunable slots 210 in first half 286 by λ/5, represented by dimension 282. Tunable slots 210 in the first half 286 may be spaced from other tunable slots 210 in first half 286 by between λ/4 and λ/5, in other embodiments. Tunable slots 210 in second half 287 may be spaced from each other similarly. In FIG. 2D, ridge 220 is disposed half way between the first half 286 and the second half 287 of the array of tunable slots 210.

Ridge 220 is configured to reduce mutual coupling between proximate (e.g. adjacent) tunable slots 210. Of course, the amount of energy of feed wave 205 that each tunable slot 210 radiates changes in response to the reactance to which the tunable slot is tuned. But, tunable slots are also prone to mutual coupling effects where the reactance from one tunable slot can cause unintended energy radiation (or lack thereof) of a proximate tunable slot 210. This unintended radiation skews the intended holographic pattern that is driven onto the array of tunable slots, which adversely affects the shaping or steering of feed wave 205. However, experimental data and modeling by Applicant indicated that including a ridge (such as ridge 220) into the waveguide (e.g. waveguide 240) reduced mutual coupling effects between proximate tunable slots 210. Thus, configuring the ridge to reduce mutual coupling made the actual steered beam (object beam) closer to the theoretical steered beam that was calculated to be the result of the feed wave encountering the holographic diffraction pattern driven onto the array of tunable slots 210. Applicant's experiments and modeling also suggested that including ridge structures into waveguides that have a metamaterial layer having tunable slots also increased bandwidth of the waveguides, which may allow for dual-band transmitting and receiving functions from a single aperture. Furthermore, using one or more ridges permits operating at a point of much lower dispersion in the propagation constant of the waveguide, thus improving formation in the steered beam. Additionally, ridges more tightly confine or concentrate feed wave 205 around the ridge resulting in less amplitude and phase perturbations that degrade holographic beam formation. As a manufacturing benefit, the more tightly confined feed wave 205 around the ridge reduces susceptibility to loss incurred around the edges of the waveguide. For example, less than ideal ohmic bonding between sidewalls 243 and conductive bonding layer 234 would not lose as much energy with a magnetic field generated by feed wave 205 concentrated around ridge 220. Concentrating/confining feed wave around ridge 220 also allows for more densely spaced waveguide channels, when a plurality of waveguide channels is used in reconfigurable holographic antenna 299. More densely spaced waveguides allow for more compact form factors of the antenna. Ridge 220, in addition to other ridges described in this disclosure may improve their corresponding antennas as described here.

FIGS. 2A and 2C show that ridge 220 includes edges 222. In some embodiments, edges 222 have tapered edges configured to reduce eddy currents induced by the feed wave 205. Reducing the eddy currents on the edges of ridges reduces signal loss in the ridged waveguides.

Figure 3:
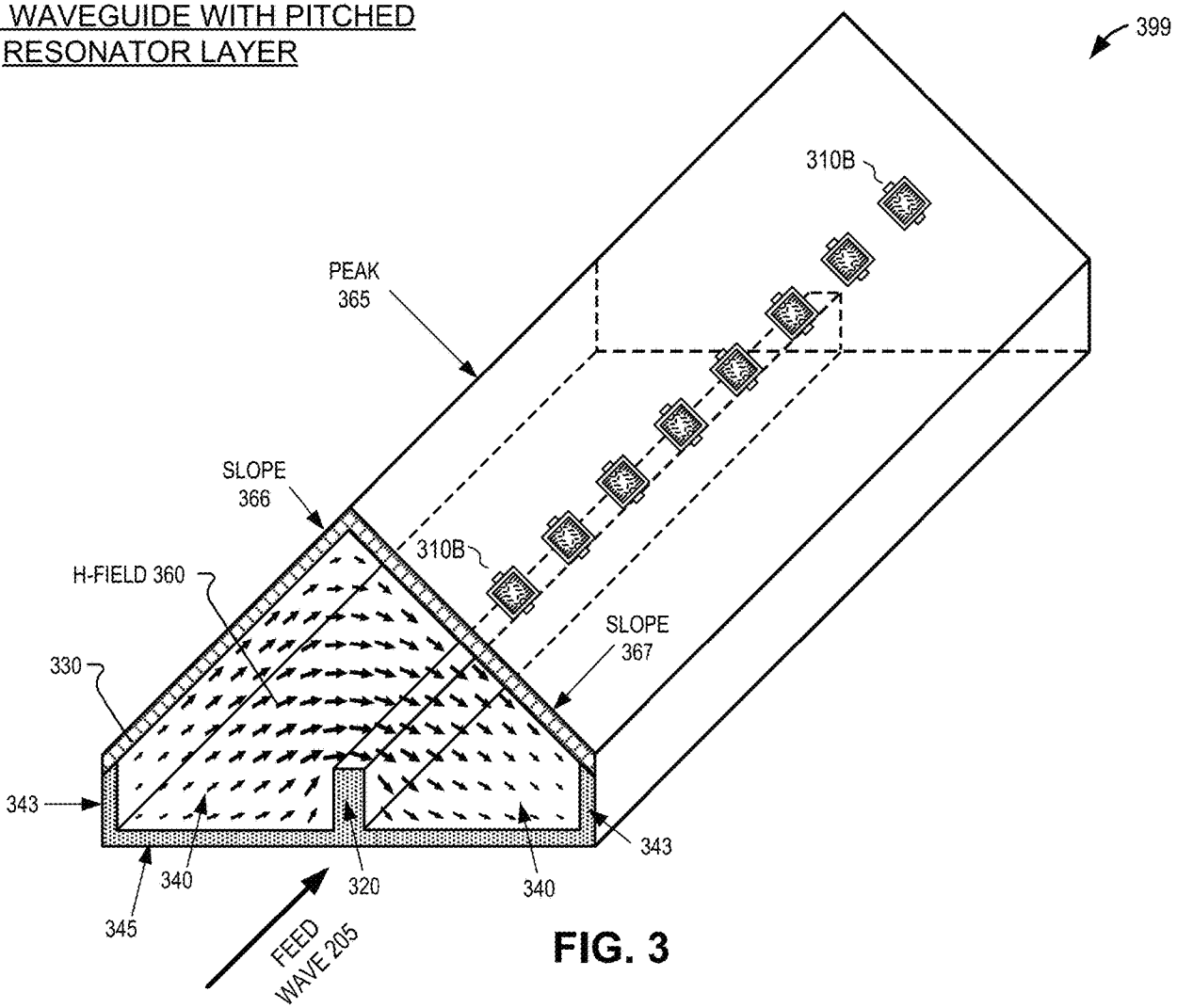
FIG. 3 illustrates a reconfigurable holographic antenna that includes a pitched array of tunable slots, in accordance with an embodiment of the disclosure.

FIG. 3 illustrates a reconfigurable holographic antenna 399 that includes a pitched metamaterial layer 330, in accordance with an embodiment of the disclosure. Reconfigurable holographic antenna 399 is similar to reconfigurable holographic antenna 299 except metamaterial layer 330 is pitched, having a peak 365 positioned directly above the ridge 320. In one embodiment, including the illustrated embodiment, peak 365 is the highest point of metamaterial layer 330. A first half of the array of tunable slots (310A) is disposed on the unseen plane of first slope 366 of the metamaterial layer 330 and the second half of the array of tunable slots (310B) is disposed on a second slope 367 of metamaterial layer 330. First slope 366 and second slope 367 slope from peak 365 down to sidewalls 343 of ridged waveguide 340. Waveguide 340 is bound by waveguide sidewalls 343, waveguide floor 345, ridge 320, and a metal layer included in metamaterial layer 330.

FIG. 3 illustrates H-field 360 that is generated by received feed wave 205. The magnitude of the arrows in H-field 360 indicates the strength of the magnetic field generated by feed wave 205. The bolder and longer arrows indicate the greatest magnitude of H-field 360 is concentrated around ridge 320 while the thinner and shorter arrows indicate the least magnitude of H-field 360 is along sidewalls 343.

Figure 4:
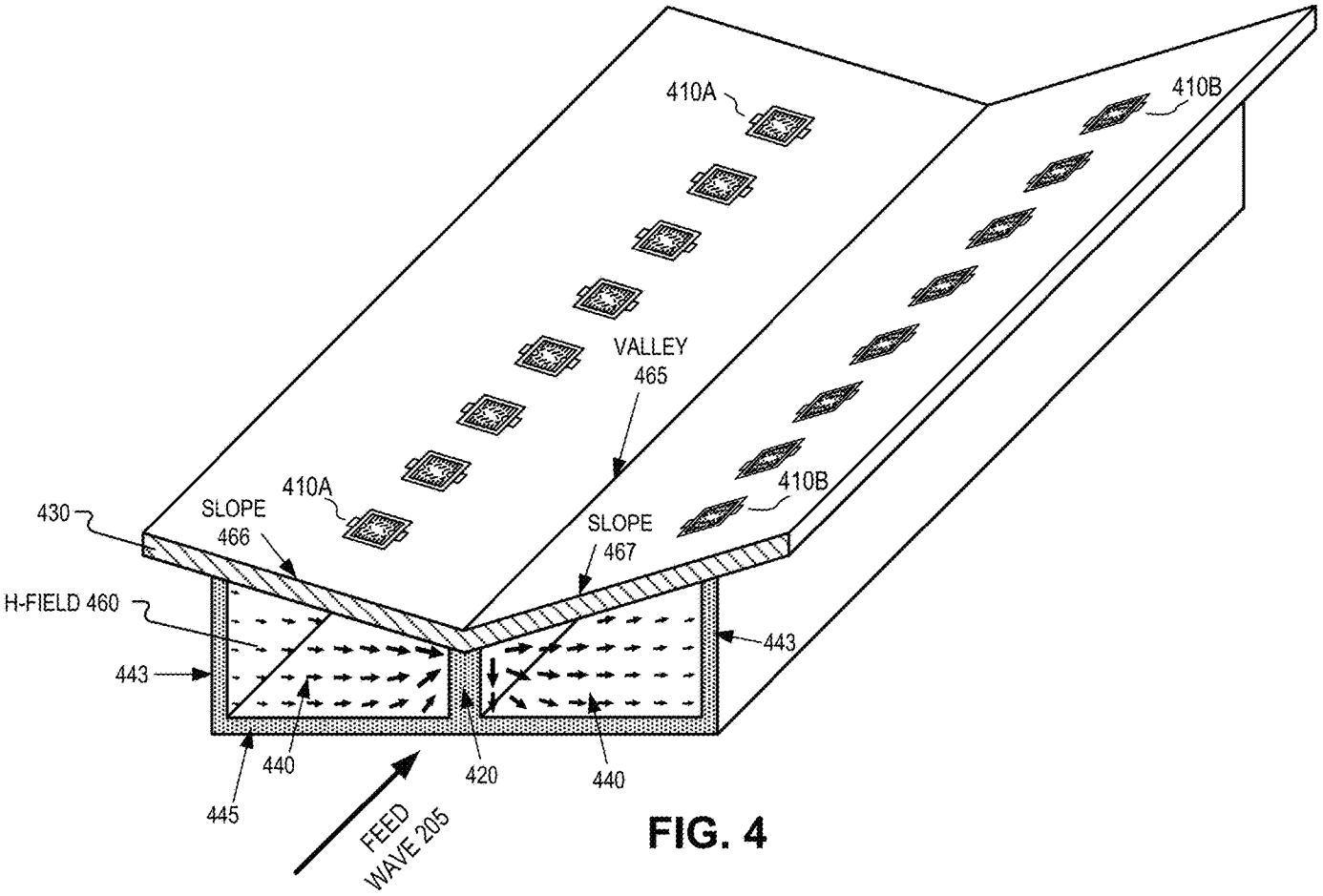
FIG. 4 illustrates a reconfigurable holographic antenna that includes an inverted array of tunable slots, in accordance with an embodiment of the disclosure.

FIG. 4 illustrates a reconfigurable holographic antenna 499 that includes an inverted metamaterial layer 430, in accordance with an embodiment of the disclosure. Reconfigurable holographic antenna 499 is similar to reconfigurable holographic antenna 299 except metamaterial layer 430 is inverted, having a valley 465 positioned directly above ridge 420. In one embodiment, including the illustrated embodiment, valley 465 is the lowest point of metamaterial layer 430. A first half of the array of tunable slots (410A) is disposed on the plane of first slope 466 of the metamaterial layer 430 and the second half of the array of tunable slots (410B) is disposed on a second slope 467 of metamaterial layer 430. First slope 466 and second slope 467 rise from valley 465 up to sidewalls 443 of ridged waveguide 440. Waveguide 440 is bound by waveguide sidewalls 443, waveguide floor 445, ridge 420, and a metal layer included in metamaterial layer 430.

FIG. 4 illustrates H-field 460 that is generated by received feed wave 205. The magnitude of the arrows in H-field 460 indicates the strength of the magnetic field generated by feed wave 405. The bolder and longer arrows indicate that the greatest magnitude of H-field 460 is concentrated around ridge 420 while the thinner and shorter arrows indicate the least magnitude of H-field 460 is along sidewalls 443.

The non-planar configuration of metamaterial layer 330/430 of reconfigurable holographic antennas 399 and 499 may achieve wider scan angles orthogonal to the waveguide channel when compared to the planar nature of metamaterial layer 230. It is appreciated that the angle of the illustrated slopes in FIG. 3 and FIG. 4 are exaggerated for illustrative and modeling purposes.

Figure 5A:
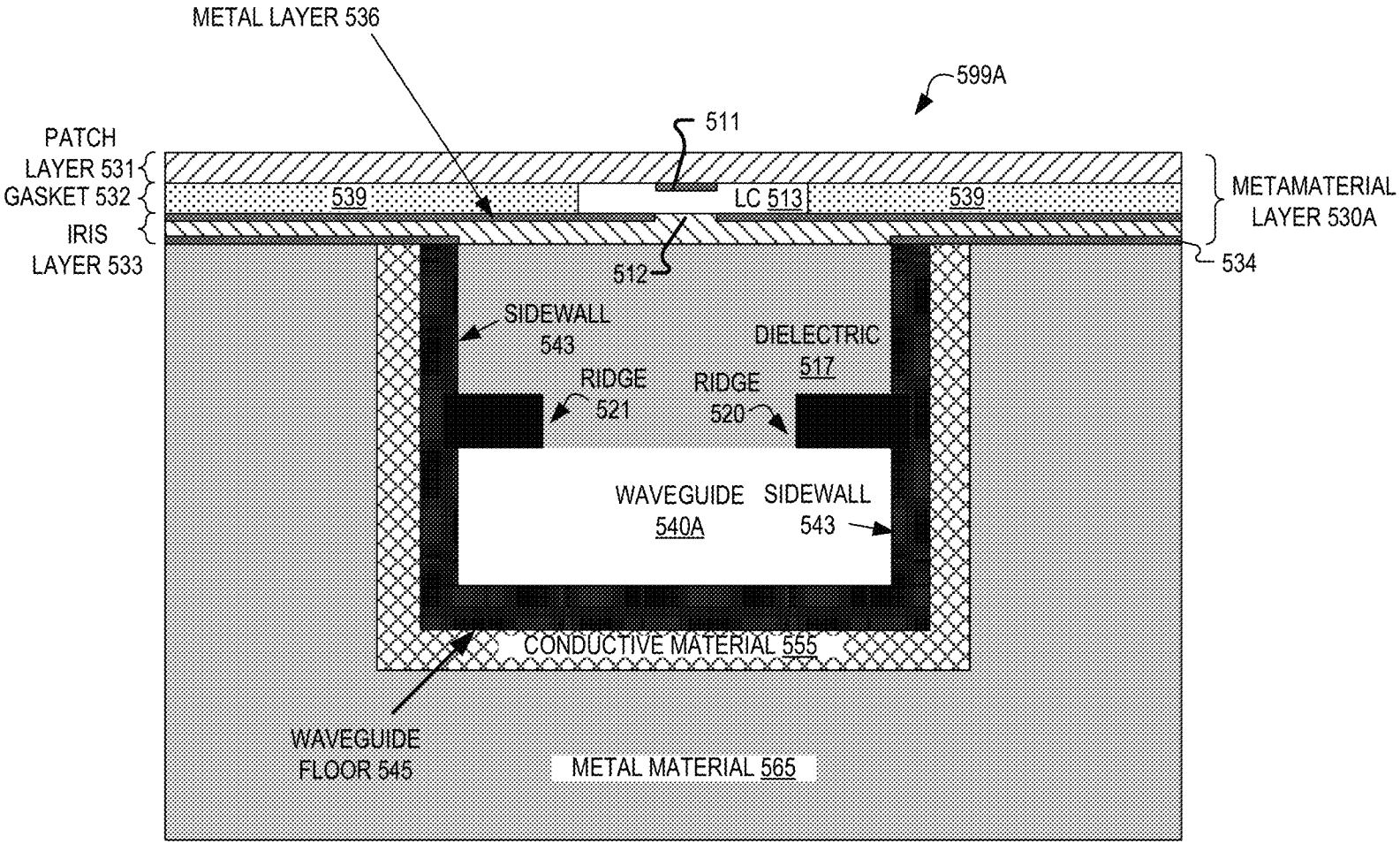
FIGS. 5A and 5B illustrate examples of reconfigurable holographic antennas that include double-ridge waveguides, in accordance with an embodiment of the disclosure.

FIG. 5A illustrates a cross section of reconfigurable holographic antenna 599A that include a double-ridge waveguide 540A, in accordance with an embodiment of the disclosure. Double-ridge waveguide 540A is bound by waveguide sidewalls 543, waveguide floor 545, ridges 520 and 521, and a metal layer 536 within iris layer 533, which is included in metamaterial layer 530A. Metamaterial layer 530A is similar to metamaterial layer 230 and includes an array of tunable slots 510. Iris/slot 512 is defined by openings in metal layer 536 which is included in iris layer 533. Tunable slots 510 include patch 511, liquid crystal 513, and iris 512. The chamber for liquid crystal 513 is defined by spacers 539, iris layer 533, and metal layer 536. The waveguide structure (illustrated as solid black in FIG. 5A) of double-ridge waveguide 540A is conductively coupled to metamaterial layer 530A by way of conductive bonding layer 534. Conductive bonding layer 534 may be a conductive epoxy, for example.

In FIG. 5A, metamaterial layer 530A is disposed as a top lid of double-ridge waveguide 540A opposite waveguide floor 545. Ridges 520 and 521 are disposed on sidewalls 543 of the double-ridge waveguide between the top lid and waveguide floor 545. Ridges 520 and 521 may have tapered edges configured to reduce eddy currents induced by feed wave 205. In FIG. 5A, a dielectric 517 fills a section of double-ridge waveguide 540A between the ridges 520 and 521 and metamaterial layer 530A. In one embodiment, dielectric 517 includes polytetrafluoroethylene. In one embodiment, dielectric 517 includes Rexolite made by C-Lec Plastics, Inc. Dielectric 517 may serve to increase the index of refraction of waveguide 540A to "slow" feed wave 205.

One way to fabricate reconfigurable holographic antenna 599A is to start with a double-ridge waveguide (made from extruded metal for example) and cut the top of the double-ridge waveguide off. Conductive material 555 and/or metal material 565 may be cut with the double-ridge waveguide or added to the double-ridge waveguide after it is cut. The double-ridge waveguide may be brazed into conductive material 555 if it is combined with materials 555 and 565 after cutting the top off. Metal material 565 may be metal or a metallized plastic. Dielectric 517 can then be formed or inserted into the waveguide structure. Next, metamaterial layer 530A is conductively bonded to conductive material 555 by way of conductive bonding layer 534. Conductive material 555 may be a conductive adhesive/epoxy or a filler metal that is bonded to conductive bonding layer 534 by a brazing process. Adhesives may also be used to secure metamaterial layer 530A to the double-ridge waveguide that includes double-ridge waveguide 540A, conductive material 555, and metal material 565. In effect, metamaterial layer 530A (and its metal layers(s) 536) replaces the cut off top of the double-ridge waveguide as the top lid of waveguide 540A with the added benefit that metamaterial layer 530A includes tunable slots 510.

Figure 5B:
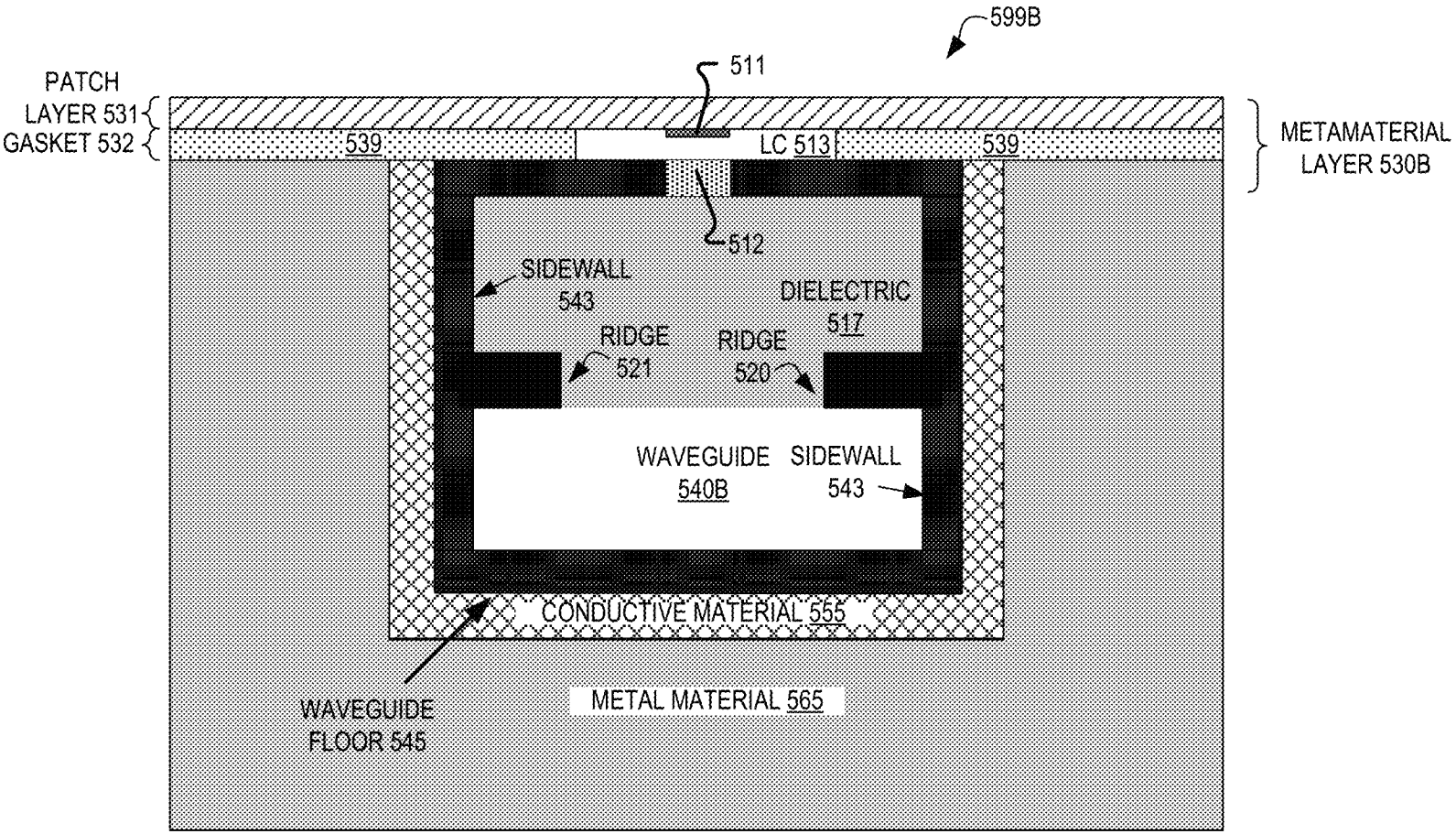

FIG. 5B illustrates a cross section of reconfigurable holographic antenna 599B that include a double-ridge waveguide 540B, in accordance with an embodiment of the disclosure. Double-ridge waveguide 540B is similar to double-ridge waveguide 540A except that iris(s) 512 are defined by openings in the contiguous structure of double-ridge waveguide 540B rather than relying on openings in metal layer 536. Hence, waveguide 540B may offer a manufacturing advantage since iris 512 may simply be machined out of a contiguous double-ridge waveguide structure, which eliminates iris layer 533 from the metamaterial layer.

To fabricate reconfigurable holographic antenna 599B, the irises/slots 512 of the tunable slots are milled into the top of the contiguous waveguide structure (e.g. extruded aluminum) that includes sidewalls 543, floor 545, and ridges 520 and 521. The slot is then filled with a dielectric (e.g. Rexolite adhesive) to define the floor of the chamber for liquid crystal 513. Spacers 539 can be adhered to the contiguous waveguide structure (illustrated as solid black), conductive material 555, and metal material 565. Then liquid crystal 513 is placed into the chamber and patch layer 531 is laminated to gasket layer 532 to seal liquid crystal 513.

Figure 6:
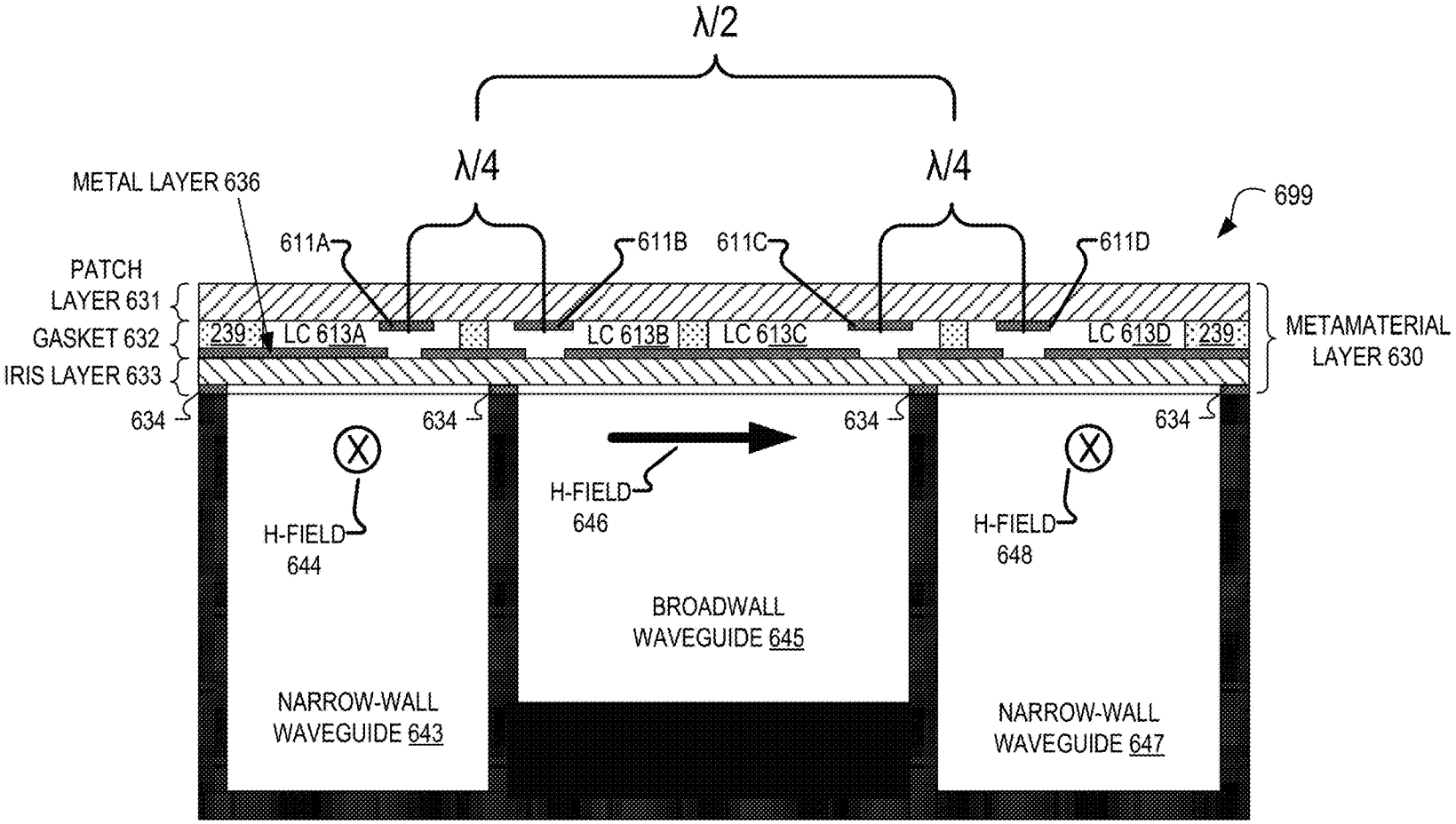
FIG. 6 illustrates an example of a reconfigurable holographic antenna that includes a broadwall waveguide adjacent to a narrow-wall waveguide, in accordance with an embodiment of the disclosure.

FIG. 6 illustrates a cross section of a reconfigurable holographic antenna 699 that includes a broadwall waveguide 645 adjacent to narrow-wall waveguides 643 and 647, in accordance with an embodiment of the disclosure. Narrow-wall waveguide 643 is configured to generate H-field 644 in response to incident feed wave 205. Similarly, narrow-wall waveguide 647 is configured to generate H-field 648 in response to incident feed wave 205. The orientation of H-field 644 and 648 is the same (into the page). Broadwall waveguide 645 is disposed between narrow-wall waveguides 643 and 647 and generates H-field 646 in response to feed wave 205. H-field 646 is oriented orthogonal to H-fields 644 and 648.

Waveguides 643, 645, and 647 are conductively coupled to metamaterial layer 630 by way of conductive bonding layer 634. Metamaterial layer 630 includes a two-dimensional array of tunable slots 610. The architecture of metamaterial layer 630 is similar to metamaterial layer 230 except that the arrangement of the array of tunable slots is different. The array of tunable slots 610 includes a first, second, third, and fourth sub-array of tunable slots.

The first sub-array includes tunable slots 610A; the second sub-array includes tunable slots 610B; the third sub-array includes tunable slots 610C; and the fourth sub-array includes tunable slots 610D. Tunable slots 610A each include a patch 611A, liquid crystal 613A and an iris 612A defined by metal layer 636; tunable slots 610B each include patch 611B, liquid crystal 613B, and an iris 612B defined by metal layer 636; tunable slots 610C each include patch 611C, liquid crystal 613C, and an iris 612C defined by metal layer 636; and tunable slots 610D each include patch 611D, liquid crystal 613D, and an iris 612D defined by metal layer 636.

The first sub-array of tunable slots is disposed above narrow-wall waveguide 643, the second and third sub-array of tunable slots are disposed above broadwall waveguide 645, and the fourth sub-array of tunable slots is disposed above narrow-wall waveguide 647. In FIG. 6, the first sub-array of tunable slots 610 is spaced from the second sub-array of tunable slots by $\lambda/4$, where $\lambda$ is a wavelength of the feed wave. The third sub-array of tunable slots is also spaced from the fourth sub-array of tunable slots by $\lambda/4$ in FIG. 6. A mid-point between the first sub-array and the second sub-array is spaced $\lambda/2$ from a mid-point between the third sub-array and the fourth sub-array, in the illustrated embodiment.

The first sub-array of tunable slots and the second sub-array of tunable slots are positioned to constructively interfere to generate a first circularly polarized wave in response to the feed wave. The third sub-array of tunable slots and the fourth sub-array of tunable slots are positioned to constructively interfere to generate a second circularly polarized wave in response to the feed wave. The first and second circularly polarized beams can be used to communicate downlink signal 105 and uplink signal 155. Microwave communication inherently includes circularly polarized beams so native generation of circularly polarized beams is beneficial in satellite communication systems. Prior approaches to generate circularly polarized beams include adding an extra layer to the antenna to circularly polarize the linearly polarized beams generated by the antenna elements. Generating circularly polarized beams with reconfigurable holographic antenna 699 natively allows for antennas with reduced thickness as the circular polarizing layer need not be added.

Figure 7A:
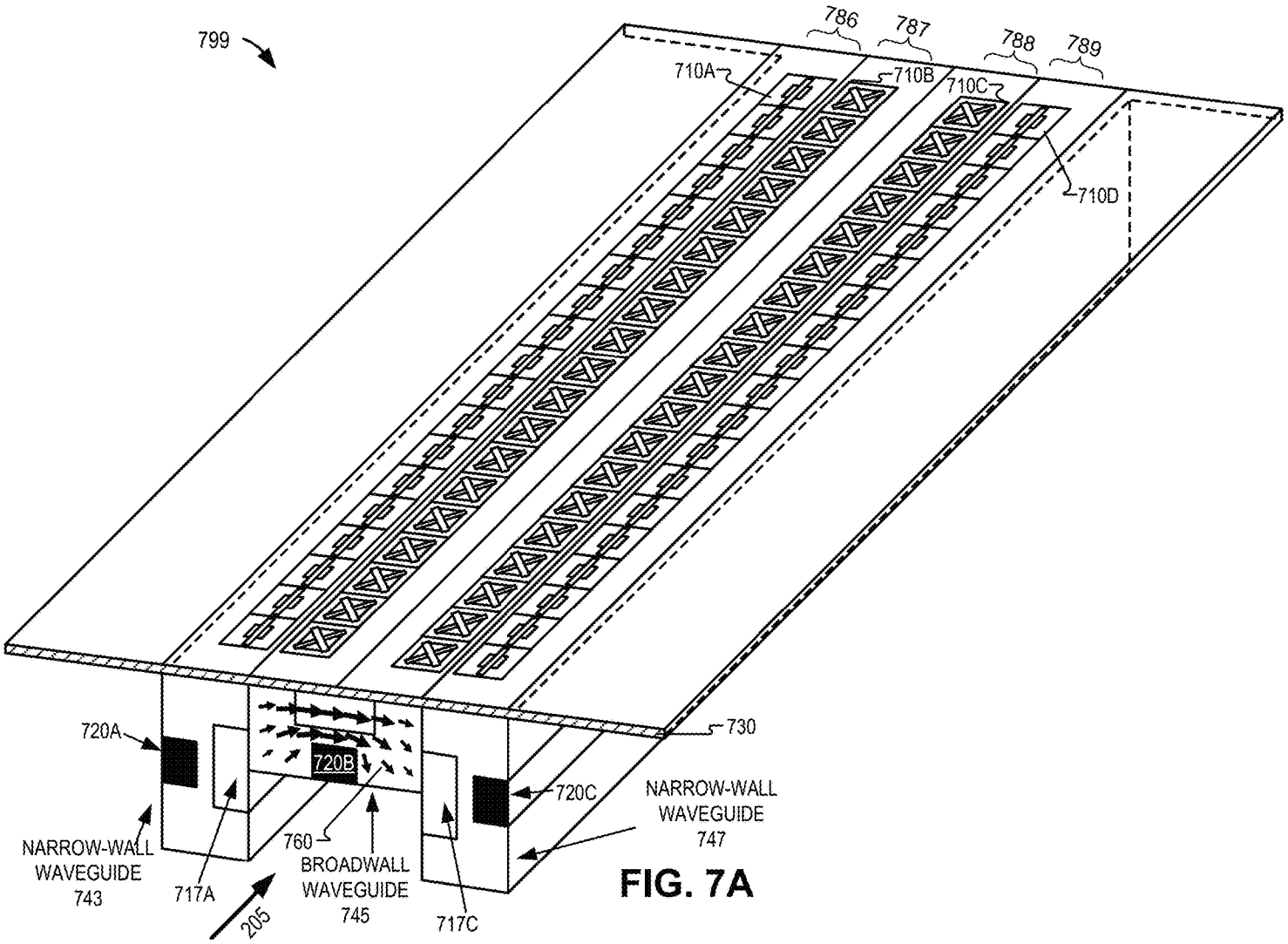
FIGS. 7A-7B illustrate a reconfigurable holographic antenna that includes a ridged broadwall waveguide adjacent to a ridged narrow-wall waveguide, in accordance with an embodiment of the disclosure.

FIG. 7A illustrates a reconfigurable holographic antenna 799 that includes a ridged broadwall waveguide 745 adjacent to ridged narrow-wall waveguides 743 and 747, in accordance with an embodiment of the disclosure. Reconfigurable holographic antenna 799 differs from reconfigurable holographic antenna 699 in that the waveguides include ridges. Narrow-wall waveguide 743 includes ridge 720A and dielectric 717A. Broadwall waveguide 745 includes ridge 720B and dielectric 717B. Narrow-wall waveguide 747 includes ridge 720C and dielectric 717C. The ridges 720 and dielectrics 717 may have the properties discussed in association with other similarly numbered elements of the disclosure. Ridges 720A-720C provide similar advantages to reconfigurable holographic antenna 799 as discussed above in connection with antennas 299-599.

Metamaterial layer 730 includes an array of tunable slots 710 similar to metamaterial layer 630. The array of tunable slots 710 includes a first, second, third, and fourth sub-array 786, 787, 788, and 789, respectively. The first sub-array includes tunable slots 710A; the second sub-array includes tunable slots 710B; the third sub-array includes tunable slots 710C; and the fourth sub-array includes tunable slots 710D. FIG. 7A shows H-field 760 that is generated by received feed wave 205. The magnitude of the arrows in H-field 760 indicates the strength of the magnetic field generated by feed wave 205. The bolder and longer arrows indicate that the greatest magnitude of H-field 760 is concentrated around ridge 720B.

Figure 7B:
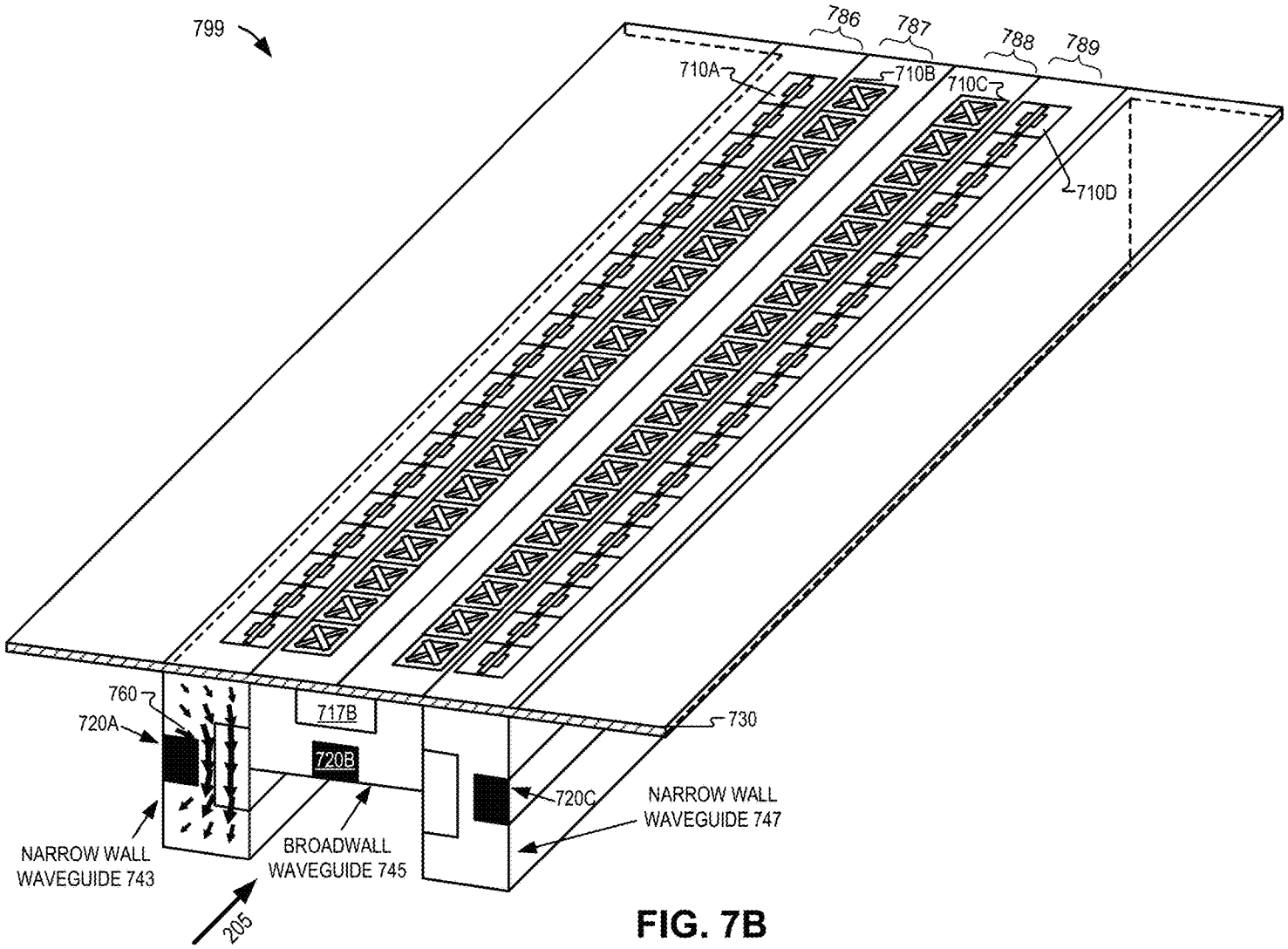

FIG. 7B also illustrates reconfigurable holographic antenna 799, but with H-field 761 illustrating the magnetic field generated in narrow-wall waveguide 743 by received feed wave 205. The bolder and longer arrows indicate that the greatest magnitude of H-field 761 is concentrated around ridge 720A. A similar H-field is formed in narrow-wall waveguide 747 by received feed wave 205.

Figure 8A:
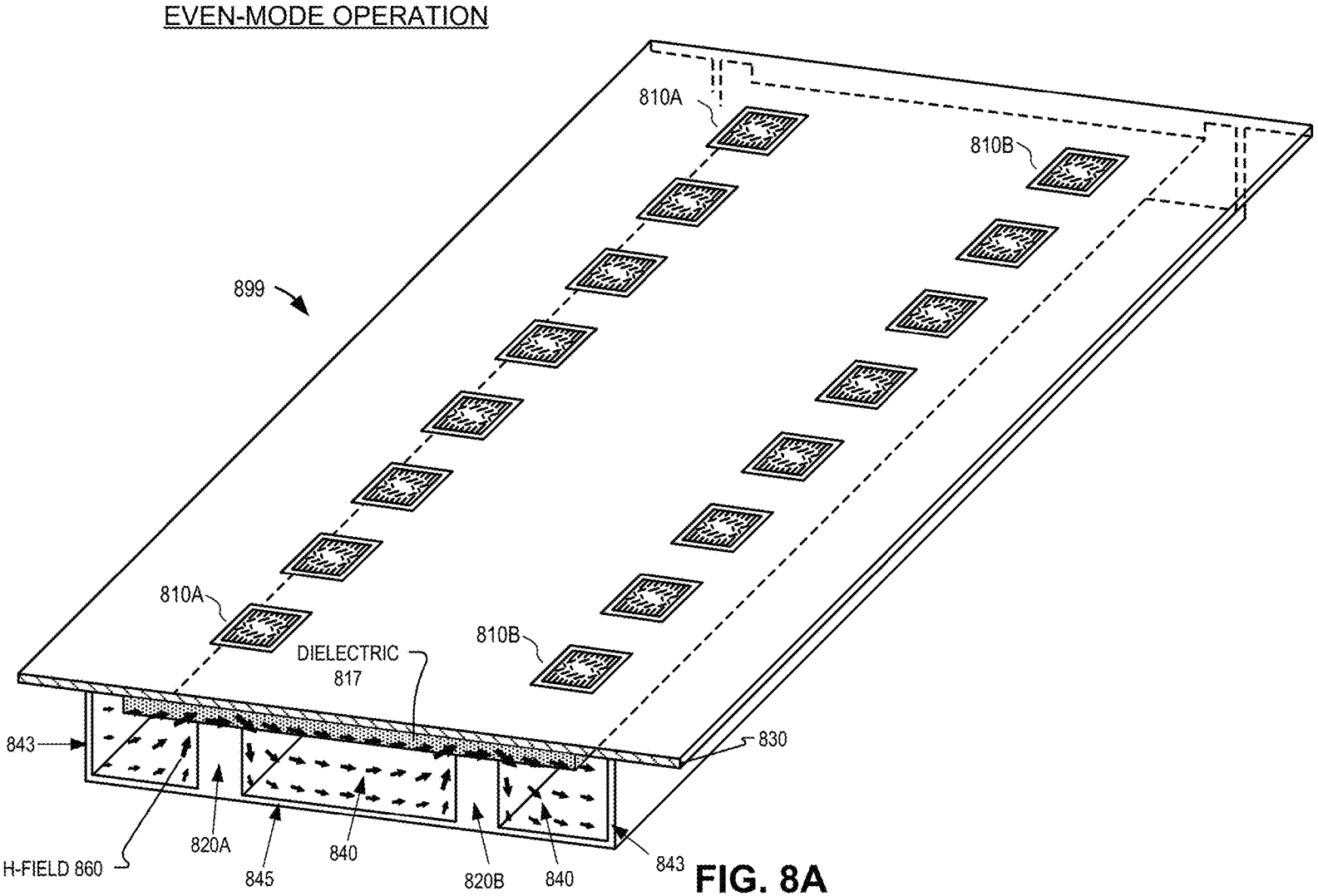
FIGS. 8A-8B illustrate a reconfigurable holographic antenna that includes a double adjacent ridge within a waveguide, in accordance with an embodiment of the disclosure.
Figure 8B:
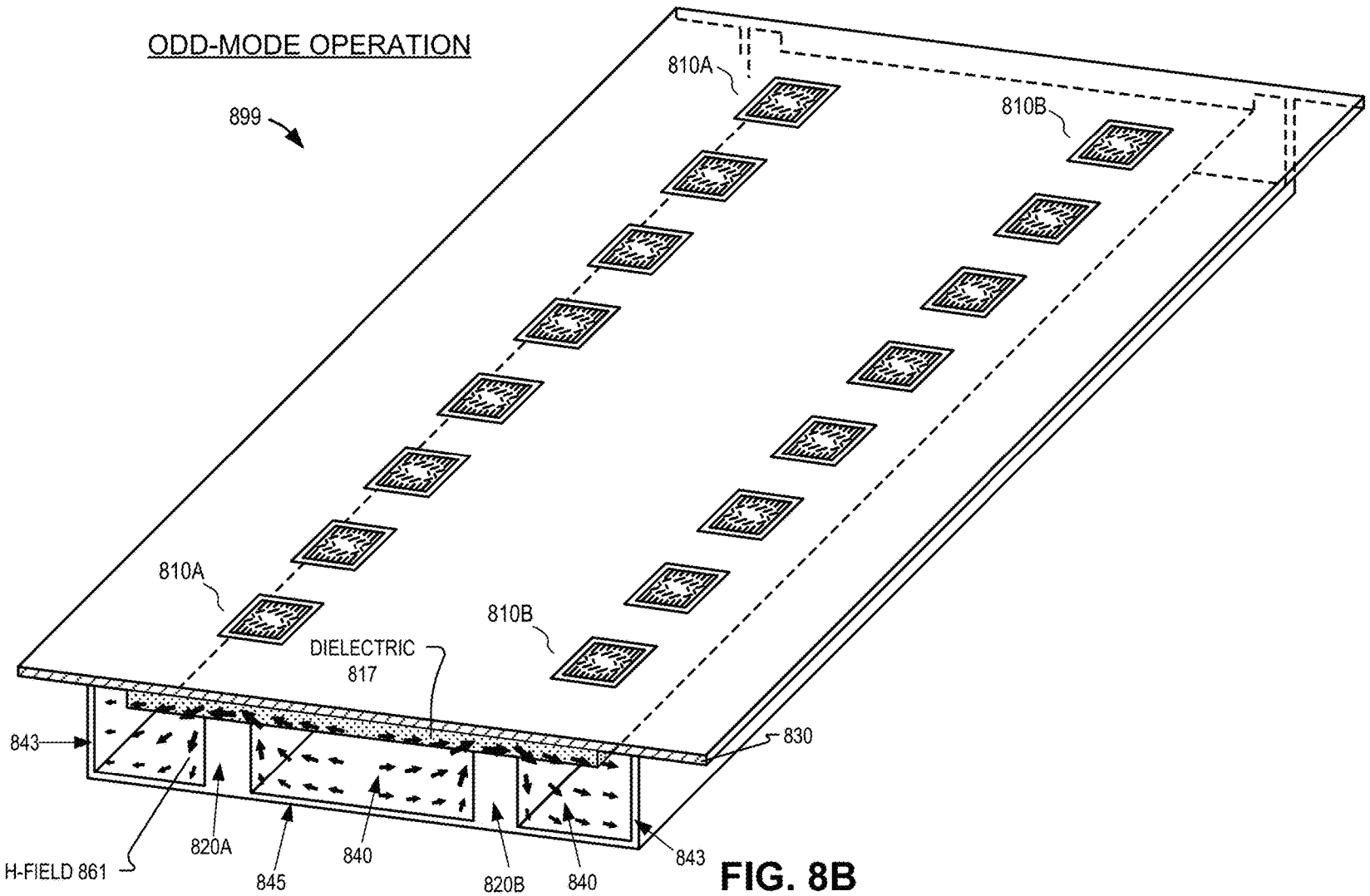

FIGS. 8A-8B illustrate a reconfigurable holographic antenna 899 that includes a double adjacent ridge within waveguide 840, in accordance with an embodiment of the disclosure. Reconfigurable holographic antenna 899 includes waveguide 840, dielectric 817, and metamaterial layer 830. Waveguide 840 is bound by waveguide sidewalls 843, waveguide floor 845, ridges 820A and 820B, and a metal layer included in metamaterial layer 830. Metamaterial layer 830 is similar to metamaterial layer 230 and includes tunable slots 810. The irises/slots 812 of the tunable slots 810 are defined by openings in a metal layer within metamaterial layer 830. Metamaterial layer 830 is coupled to double-ridge waveguide 840 as a top lid disposed opposite a waveguide floor 845 of double-ridge waveguide 840.

Ridge 820A is configured to facilitate a first communication signal, in FIG. 8A. Metamaterial layer 830 includes a first array of tunable slots 810A configurable to form first holographic diffraction patterns to generate a steered first communication signal in response to the first communication signal. In other words, the first holographic diffraction patterns can steer a feed signal (e.g. downlink signal 105) to a receiver or first holographic diffraction patterns can steer a feed signal in the required direction to send to a satellite as uplink signal 155. The first array of tunable slots 810A is located along ridge 820A.

Ridge 820B is configured to facilitate a second communication signal, in FIG. 8A. Metamaterial layer 830 includes a second array of tunable slots 810B configurable to form second holographic diffraction patterns to generate a steered second communication signal in response to the second communication signal. In other words, the second holographic diffraction patterns can steer a feed signal (e.g. downlink signal 105) to a receiver or second holographic diffraction patterns can steer a feed signal in the required direction to send to a satellite as uplink signal 155. The second array of tunable slots 810B is located along ridge 820B.

In one embodiment, ridge 820A and the first array of tunable slots 810A is configured to receive the first communication signal on a first band (e.g. approximately 20 GHz.) and the ridge 820B and the second array of tunable slots 810B is configured to receive the second communication signal on a second band (e.g. approximately 12 GHz.) having a different frequency than the first band. In this embodiment, the first and second communication signals can be received simultaneously by reconfigurable holographic antenna 899.

In another embodiment, ridge 820A and the first array of tunable slots 810A is configured to receive the first communication signal on a first band and ridge 820B and the second array of tunable slots 810B is configured to transmit the second communication signal on the first band (which has the same frequency). In this embodiment, the first communication signal is being received simultaneously with transmitting the second communication signal.

Ridge 820A and ridge 820B may have tapered edges configured to reduce eddy currents induced by the first communication signal and the second communication signal, respectively. Ridge 820A and ridge 820B are disposed lengthwise down double-ridge waveguide 840, in FIG. 8A. Dielectric layer 817 is disposed between the metamaterial layer and tops of ridges 820A and 820B, in the illustrated embodiment.

FIG. 8A illustrates an "even-mode" operation of reconfigurable holographic antenna 899 in which simultaneous transmit and receive of the same band or simultaneous receiving of two different bands can be achieved. The arrows of H-field 860 illustrate the magnetic field in waveguide 840 that is generated in even-mode.

FIG. 8B illustrates an "odd-mode" operation of reconfigurable holographic antenna 899 in which differential signaling is used to incorporate different feeds from opposite directions. In odd-mode operation, adjacent channels must be phase-offset by 180 degrees to avoid a split beam result. The arrows of H-field 861 illustrate the magnetic field in waveguide 840 that is generated in odd-mode.

Reconfigurable holographic antenna 899 may also be configured for dual polarization reception by configuring ridge 820A to receive a right-hand circularly polarized first communication signal and by configuring ridge 820B to receive a left-hand circularly polarized second communication signal. Dual polarization reception is possible in both even-mode and odd-mode. Dual polarization reception is advantageous when the native transmission of the first communication signal and the second communication signal are right-hand circularly polarized and left-hand circularly polarized, respectively.

The waveguide structures described in FIGS. 2A-8B may also benefit from filling the waveguide cavity with dielectric foam to form a planar surface to build/assemble the iris layer and patch layer of the metamaterial layers upon. Filling the waveguide cavity with dielectric foam may serve to increase mechanical stability of the waveguide. In one embodiment, a 2-part expanding foam product is used. ECCOSTOCK® FPH made by Emerson & Cuming Microwave Products is a high temperature polyurethane (isocyanate) 2-part foam-in-place resin system that has low dielectric loss and rigidity that can be used to fill the waveguide cavity. Injection molding may also be used to manufacture dielectric elements to be inserted into waveguides. ECCOSTOCK® Hik-TPO and ECCOSTOCK® Hik-TPOF made by Emerson & Cuming Microwave Products have controlled dielectric constants ranging from 2.2 to 11.5 and may be used as injection molding materials.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A reconfigurable holographic antenna comprising:

a metamaterial layer including an array of tunable slots configurable to form holographic diffraction patterns, wherein a reactance of each tunable slot in the array of tunable slots is individually tunable; and a ridged waveguide including a ridge configured to reduce mutual coupling between proximate tunable slots in the array of tunable slots when a received feed wave propagates through the ridged waveguide, wherein the ridge of the ridged waveguide is disposed lengthwise down the ridged waveguide, and wherein a first portion of the array of tunable slots is disposed on a first part of the metamaterial layer having a first slope and a second portion of the array of tunable slots is disposed on a part of the metamaterial layer having a second slope with the ridge being located beneath where the first and second parts of the metamaterial layer meet, wherein the metamaterial layer is conductively coupled to the ridged waveguide, and wherein the holographic diffraction patterns formed by the array of tunable slots generate a desired antenna wave in response to the received feed wave.

2. The reconfigurable holographic antenna of claim 1, wherein the first and second portions of the array of tunable slots comprises a first half and a second half of the array of tunable slots.

3. The reconfigurable holographic antenna of claim 2, wherein a peak of the metamaterial layer is positioned directly above the ridge, and wherein the first half of the array of tunable slots is disposed on the first slope of the metamaterial layer and the second half of the array of tunable slots is disposed on the second slope of the metamaterial layer, the first slope and the second slope sloping from the peak of the metamaterial layer down to sidewalls of the ridged waveguide.

4. The reconfigurable holographic antenna of claim 2, wherein a valley of the metamaterial layer is positioned directly above the ridge, and wherein the first half of the array of tunable slots is disposed on the first slope of the metamaterial layer and the second half of the array of tunable slots is disposed on the second slope of the metamaterial layer, the first slope and the second slope rising from the valley of the metamaterial layer up to sidewalls of the ridged waveguide.

5. The reconfigurable holographic antenna of claim 2, wherein the first half of the array of tunable slots is spaced from the second half of the array of tunable slots by $\lambda/2$, where $\lambda$ is a wavelength of the received feed wave.

6. The reconfigurable holographic antenna of claim 1, wherein the ridge of the ridged waveguide has tapered edges configured to reduce eddy currents induced by the received feed wave.

7. The reconfigurable holographic antenna of claim 1, wherein a dielectric layer is disposed between a top of the ridge and the metamaterial layer.

8. The reconfigurable holographic antenna of claim 1 further comprising:

a control module coupled to modulate the array of tunable slots to form the holographic diffraction patterns, wherein the holographic diffraction patterns are generated in response to a spatial relationship between the reconfigurable holographic antenna and a satellite.

9. The reconfigurable holographic antenna of claim 1, wherein said tuning the reactance of each of the tunable slots includes varying a voltage across liquid crystal disposed within each of the tunable slots.

10. The reconfigurable holographic antenna of claim 1, wherein each of the tunable slots in the array of tunable slots includes:

an iris defined by an opening in a metal layer of the metamaterial layer; and a radiating patch co-located with the iris, wherein a tunable dielectric is disposed between the iris and the radiating patch.

11. The reconfigurable holographic antenna of claim 1, wherein the metamaterial layer is positioned as a top lid of the ridged waveguide.

12. The reconfigurable holographic antenna of claim 1, wherein the metamaterial layer is conductively bonded to sidewalls of the ridged waveguide.

13. A reconfigurable holographic antenna comprising:

a metamaterial layer including an array of tunable slots configurable to form holographic diffraction patterns, wherein a reactance of each slot in the array of tunable slots is individually tunable; and a double-ridge waveguide including two ridges positioned to reduce mutual coupling between proximate tunable slots in the array of tunable slots when a received feed wave propagates through the double-ridge waveguide, wherein the holographic diffraction patterns formed by the array of tunable slots generate a desired antenna wave in response to the received feed wave, wherein the two ridges are disposed lengthwise down the double-ridge waveguide, and further wherein the array of tunable slots comprises a first array of tunable slots on a portion of the metamaterial layer above a first ridge of the two ridges and a second array of tunable slots on a portion of the metamaterial layer above a second ridge of the two ridges, the first array of tunable slots configurable to form a first holographic diffraction pattern to steer a feed signal to at least receive or transmit a first communication signal on a first band and the second array of tunable slots configurable to form a second holographic diffraction pattern to steer a feed signal to at least receive or transmit a second communication signal on a second band, the first and second bands being different.

14. The reconfigurable holographic antenna of claim 13, wherein the metamaterial layer is disposed as a top lid of the double-ridge waveguide opposite a floor of the double-ridge waveguide and wherein the two ridges are formed on sidewalls of the double-ridge waveguide between the top lid and the floor of the double-ridge waveguide.

15. The reconfigurable holographic antenna of claim 14, wherein a dielectric fills a section of the double-ridge waveguide between the two ridges and the top lid of the double-ridge waveguide.

16. The reconfigurable holographic antenna of claim 13, wherein the double-ridge waveguide is conductively coupled to the metamaterial layer.

17. The reconfigurable holographic antenna of claim 13, wherein the two ridges of the double-ridge waveguide has tapered edges configured to reduce eddy currents induced by the received feed wave.

18. The reconfigurable holographic antenna of claim 13 further comprising:

a control module coupled to modulate the array of tunable slots to form the holographic diffraction patterns, wherein the holographic diffraction patterns are generated in response to a spatial relationship between the reconfigurable holographic antenna and a satellite.

19. The reconfigurable holographic antenna of claim 13, wherein said tuning the reactance of each of the tunable slots includes varying a voltage across liquid crystal disposed within each of the tunable slots.

20. The reconfigurable holographic antenna of claim 13, wherein each of the tunable slots in the array of tunable slots includes:

an iris defined by an opening in a metal layer of the metamaterial layer; and a radiating patch co-located with the iris, wherein a tunable dielectric is disposed between the iris and the radiating patch.

21. The reconfigurable holographic antenna of claim 13, wherein each of the tunable slots in the array of tunable slots includes:

an iris defined by an opening in a top of the double-ridge waveguide, wherein the top of the double-ridge waveguide is made from a contiguous structure that also includes sidewalls and a floor of the double-ridge waveguide; and a radiating patch co-located with the iris, wherein a tunable dielectric is disposed between the iris and the radiating patch.

* * * * *